US005444830A

United States Patent [19]

Oh et al.

[11] Patent Number: 5,444,830

[45] Date of Patent: Aug. 22, 1995

[54] METHOD AND APPARATUS FOR CONTROLLING EXPOSURE AND TRANSFERENCE IN AN ELECTROPHOTOGRAPHIC RECORDING APPARATUS

[75] Inventors: Soo-Hwan Oh, Suwon; Byeong-Oh Park, Seoul, both of Rep. of Korea

[73] Assignee: SamSung electronics Co., Ltd., Suwon, Rep. of Korea

[21] Appl. No.: 18,244

[22] Filed: Feb. 16, 1993

[30] Foreign Application Priority Data

Feb. 19, 1992 [KR] Rep. of Korea ..... 1992-2487
Mar. 23, 1992 [KR] Rep. of Korea ..... 1992-4764

[51] Int. Cl.[6] ..... G03G 15/00
[52] U.S. Cl. ..... 395/109
[58] Field of Search ..... 395/106, 108, 109; 358/75, 76, 300; 430/54

[56] References Cited

U.S. PATENT DOCUMENTS 4,477,549 10/1984 Fujimaki et al. ..... 430/54
4,493,549 1/1985 Thomas et al. ..... 355/3
4,522,483 6/1985 Matsumoto et al. ..... 355/3 R
4,728,991 3/1988 Takayama et al. ..... 355/14
4,811,052 3/1989 Yamakawa et al. ..... 355/14
4,855,767 4/1988 Sato et al. ..... 346/160
5,164,745 10/1990 Matsuoka ..... 346/108
5,237,371 8/1993 Hori ..... 355/246
5,257,037 10/1993 Haneda et al. ..... 346/76 L

FOREIGN PATENT DOCUMENTS 0320915 6/1989 European Pat. Off. .
57-074767 5/1982 Japan .
62-056976 3/1987 Japan .
62-209533 9/1987 Japan .
62-223766 10/1987 Japan .
62-226174 10/1987 Japan .
62-235977 10/1987 Japan .
62-269153 11/1987 Japan .

*Primary Examiner*—Mark R. Powell
*Assistant Examiner*—Gabriel I. Garcia
*Attorney, Agent, or Firm*—Robert E. Bushnell

[57] ABSTRACT

A method and apparatus for controlling an exposure and preventing reverse charge in a printer of an electrophotographic developing system. A method for preventing reverse charge comprises the steps of: starting print paper feeding, turning on a charge unit, a register sensor and an exposing unit, and checking if the top of a paper reaches a transfer unit; if the top of the paper reaches the transfer unit, turning on the transfer unit; checking if the register sensor is turned off; if the register sensor is turned off, checking if it is time the bottom of the paper reaches the transfer unit; and if the time elapses, turning off the transfer unit, performing fusing, and turning off the charge unit.

26 Claims, 5 Drawing Sheets

METHOD AND APPARATUS FOR CONTROLLING EXPOSURE AND TRANSFERENCE IN AN ELECTROPHOTOGRAPHIC RECORDING APPARATUS

BACKGROUND OF THE INVENTION

The present invention relates to an electrophotographic recording apparatus, and more particularly to a method and apparatus for controlling exposure and transfer units in an electrophotographic recording apparatus capable of eliminating unnecessary exposure and reverse charge of a photosensitive drum by controlling the exposure in response to an actually supplied paper size.

Generally, a printer of an electrophotographic recording apparatus has, as shown in FIG. 1, a photosensitive drum 107 for forming an electrostatic latent image, a charge unit 104 for providing a uniform negative charge to the photosensitive drum 107, an exposing unit 105 for generating the electrostatic latent image to the photosensitive drum 107, a developing unit 108 for developing a latent image exposed to the photosensitive drum 107, a transfer unit 106 for transferring a developer formed in the photosensitive drum 107 to a print medium such as paper, a register roller 109 for feeding the paper, a feed path 98 upon which the paper is fed through the printer a fusing unit 103 for fusing the developer transferred to the paper, and resister sensors 101 and 111 for sensing the feeding state of the paper.

Referring to FIG. 2, a block diagram of a controller for controlling the printer of FIG. 1 is shown. A mechanical controlling circuit 201 produces signals for controlling a motor and each mechanical part. Control signals for controlling the charge, developing and transfer units 104, 108 and 106 are generated from a developing processor controlling circuit 202. A sensor input circuit 203 receives the sensed values of various sensors, and an image data generating circuit 205 generates data corresponding to contents to be printed on the paper. An interface circuit 206 is interfaced with an external unit, and a central processing unit (CPU) and controlling circuit 204 controls the whole controller.

In the case of printing, the system constructed as shown in FIGS. 1 and 2 waits for a printing command from a ready state. When the printing command is given, the paper size to be printed and conditions of a developing processor are set in the interior of the CPU and controlling circuit 204. A paper feeding condition of the developing processor is set, after arranging the paper in the register roller 109, by subtracting the exposing length AB on the photosensitive drum 107 from the length BD between the transfer unit 106 and the register roller 109. After feeding the paper by the set length ($B_b$-$A_B$), the exposure is started to equalize a top margin of the paper and data. In this case, if the paper is normally fed, the paper corresponding to the set length is exposed to the light and the exposing and developing conditions are released. Thereafter, a printing operation is ended by discharging the paper and the system waits for a next command. If there is an error in the paper feeding, the error is sensed by the jam sensors 101 and 111 wherein the sensor 111 is a register sensor and the other sensor 101 is an exit sensor, and processed by the CPU and controlling circuit 204.

Meanwhile, the CPU and controlling circuit 204 receives and processes the data through the interface circuit 206 from a computer or a video controller and transmits it to the image data generating circuit 205. The image data generating circuit 205 processes the data and provides it to the exposing unit 105.

In more detail, as shown in FIG. 3, if the printing command is given, the paper size is determined, at step 3*a*, by a cassette sensor. The paper is picked up from a cassette and paper feeding is started at step 3*b*. At steps 3*c* and 3*d*, the charge and exposing units 104 and 105 are turned on. The CPU and controlling circuit 204 checks, at step 3*e*, whether or not the top of the paper reaches the transfer unit 106 through the register roller 109. If the top of the paper reaches the transfer unit 106, at step 3*f*, the CPU and controlling unit 204 turns on the transfer unit 106 to transfer a toner image formed on the photosensitive drum 107 to the paper. At step 3*g*, a check is made to see if the bottom of the paper reaches the transfer unit 106. If the bottom of the paper reaches the transfer unit 106, the transfer unit 106 is turned off at step 3*h*. At step 3*i*, the fusing is performed, and at step 3*j*, the charge unit 104 is turned off. That is, the transfer unit 106 is turned off after the paper, A4 size for example, passes as much as the A4 size.

As described above, in the case of printing a shorter paper than a standard paper of the cassette, since the transfer unit 106 is turned on until the time of standard paper passes out, the toner is dropping to the transfer unit 106. Consequently, a printing image of a next paper is affected. Further, since the photosensitive drum 107 is reversely charged by a positive voltage of transfer unit, the printing quality degrades. In other words, if a shorter paper than a standard paper is fed, data is generated on the part where the paper does not exist. At this time, the photosensitive drum 107 is subjected to exposure by the exposing unit 105. Thus, since the developer is transmitted to the photosensitive drum 107 from the developing unit 108, the transfer unit 106 is contaminated and the transfer efficiency is reduced. Moreover, the developer transferred to the transfer unit 106 is unnecessarily consumed and the photosensitive drum 107 is unnecessarily exposed, thereby shortening the printing machine's life.

SUMMARY OF THE INVENTION

It is therefore an object of the present invention to provide an apparatus and method capable of preventing the unnecessary exposure of the photosensitive drum, the consumption of the developer and the contamination of the transfer unit by controlling an exposure according to the size of an actually supplied paper.

It is another object of the present invention to provide a method capable of reducing undesirable effect on the printing quality by preventing the reverse charge.

It is a further object of the present invention to provide a method capable of preventing the unnecessary contamination of the toner by controlling a period of time until the transfer unit is turned off after it is turned on when printing a shorter paper than a standard paper of a cassette.

According to one aspect of the present invention, a method for preventing reverse charge comprises the steps of: starting print paper feeding, turning on a charge unit, a register sensor and an exposing unit, and checking if the top of a paper reaches a transfer unit; if the top of the paper reaches the transfer unit, turning on the transfer unit; checking if the register sensor is turned off; if the register sensor is turned off, checking if it is time the bottom of the paper reaches the transfer unit;

and if the time elapses, turning off the transfer unit, performing fusing, and turning off the charge unit.

According to another aspect of the present invention, a method for controlling an exposure comprises the steps of: setting the size of a paper to be printed and conditions of a developing processor according to a printing command; arranging the paper in a register roller, starting an exposure when the paper is moved by a given length, and equalizing a top margin of the paper and image data; checking if the bottom of the paper passes through a register sensor; and enabling the exposure until exposure image data reaches the bottom of the paper and then disabling the exposure after the image data reaches the bottom of the paper, whereby the exposure is carried out according to the actual size of the paper supplied in spite of any image data from an external device, such as a computer.

BRIEF DESCRIPTION OF THE DRAWINGS

Other objects and advantages will become more apparent from the following description of illustrative embodiments, when read in conjunction with the accompanying drawings wherein.

DETAILED DESCRIPTION THE PREFERRED EMBODIMENT

Figure 1:
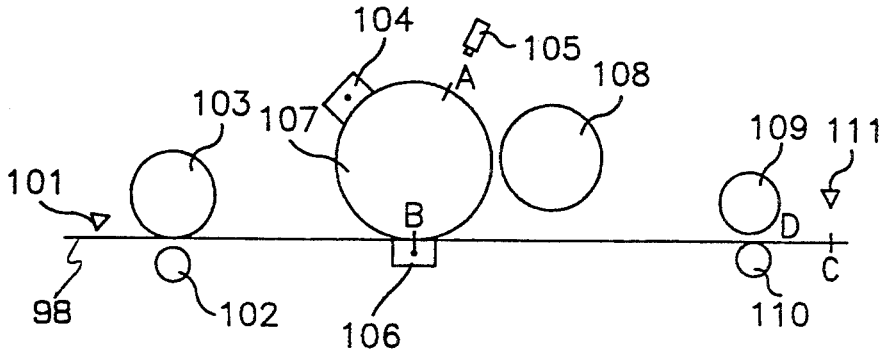
FIG. 1 is a diagram showing a printer of a typical electrophotographic recording apparatus.
Figure 2:
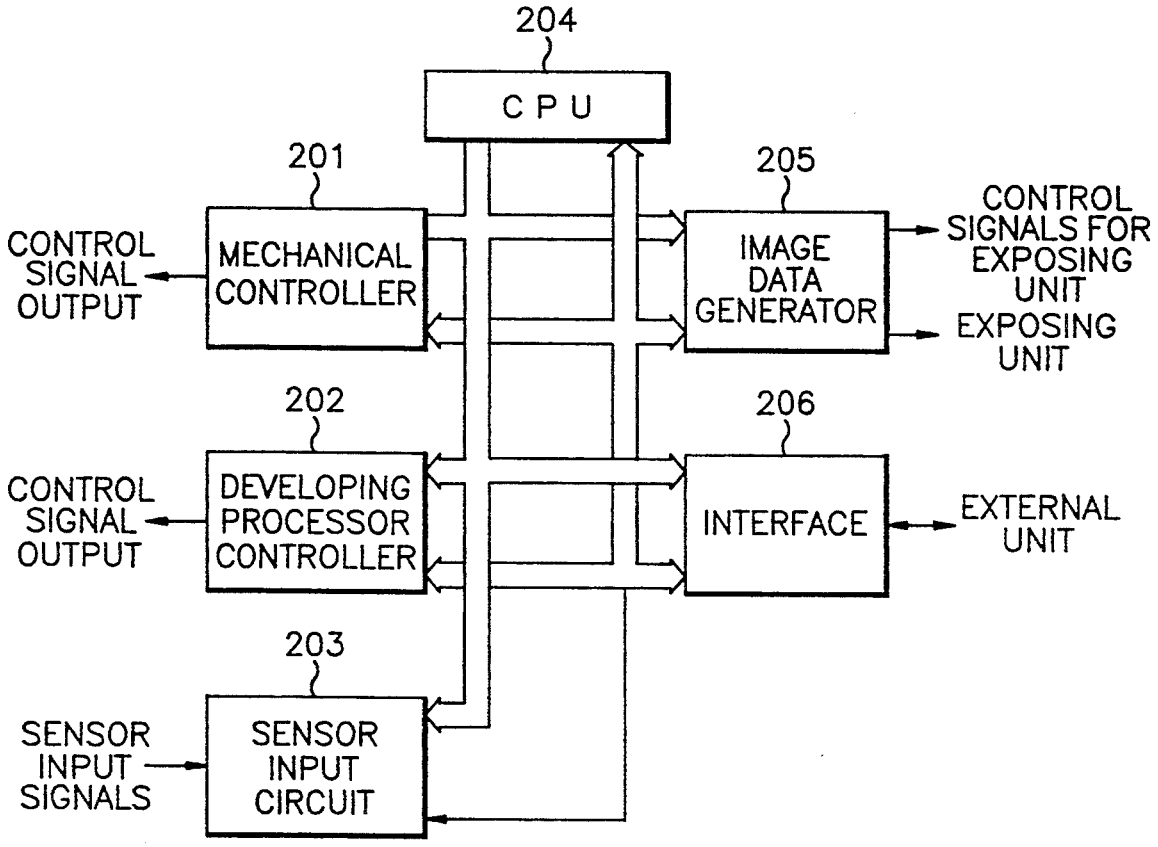
FIG. 2 is a block diagram of a conventional controller for controlling the printer shown in FIG. 1.
Figure 3:
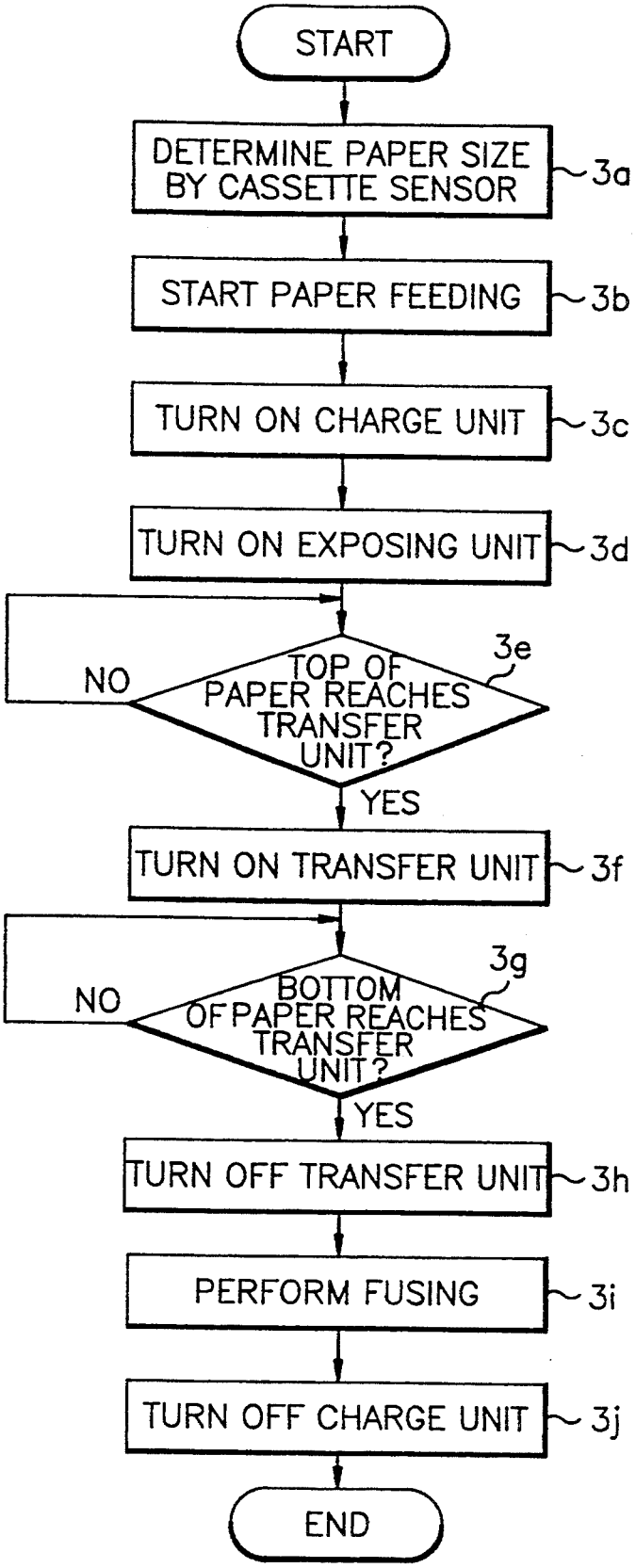
FIG. 3 is a flow chart showing a conventional printing operation.
Figure 4:
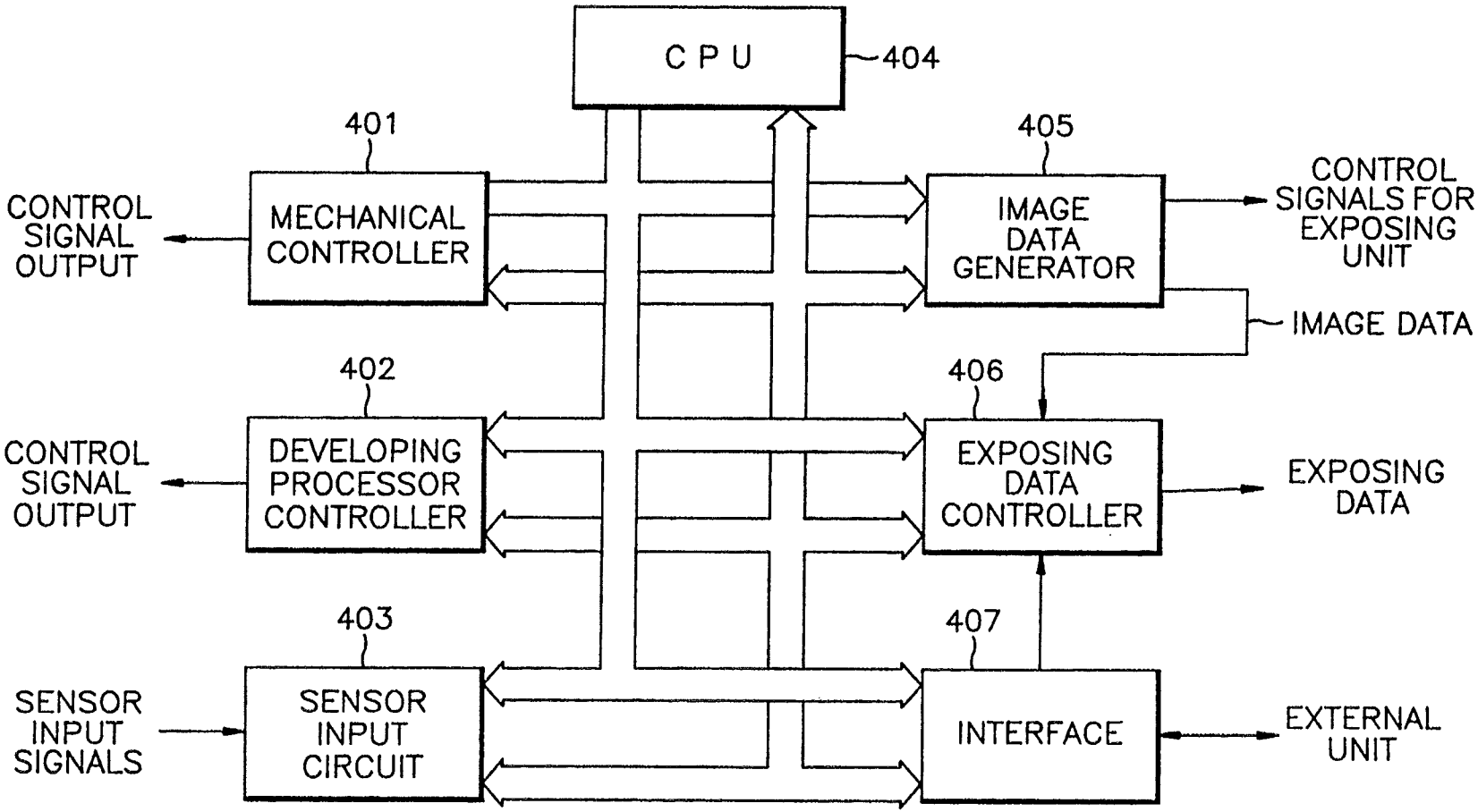
FIG. 4 is a block diagram of a system applied to the present invention.

Referring to FIG. 4, the system includes a mechanical controlling circuit 401 for controlling the paper feeding, a developing processor controlling circuit 402 for controlling an electrophotographic processor, a sensor input circuit 403 for sensing the state of various sensors, an interface circuit 407 for providing an interface between an external unit and the system, an image data generating circuit 405 for generating image data and controlling an exposure, an exposing data controlling circuit 406 for providing exposing data to the exposing unit, and a CPU and controlling circuit 404 for controlling these whole operations.

Figure 5:
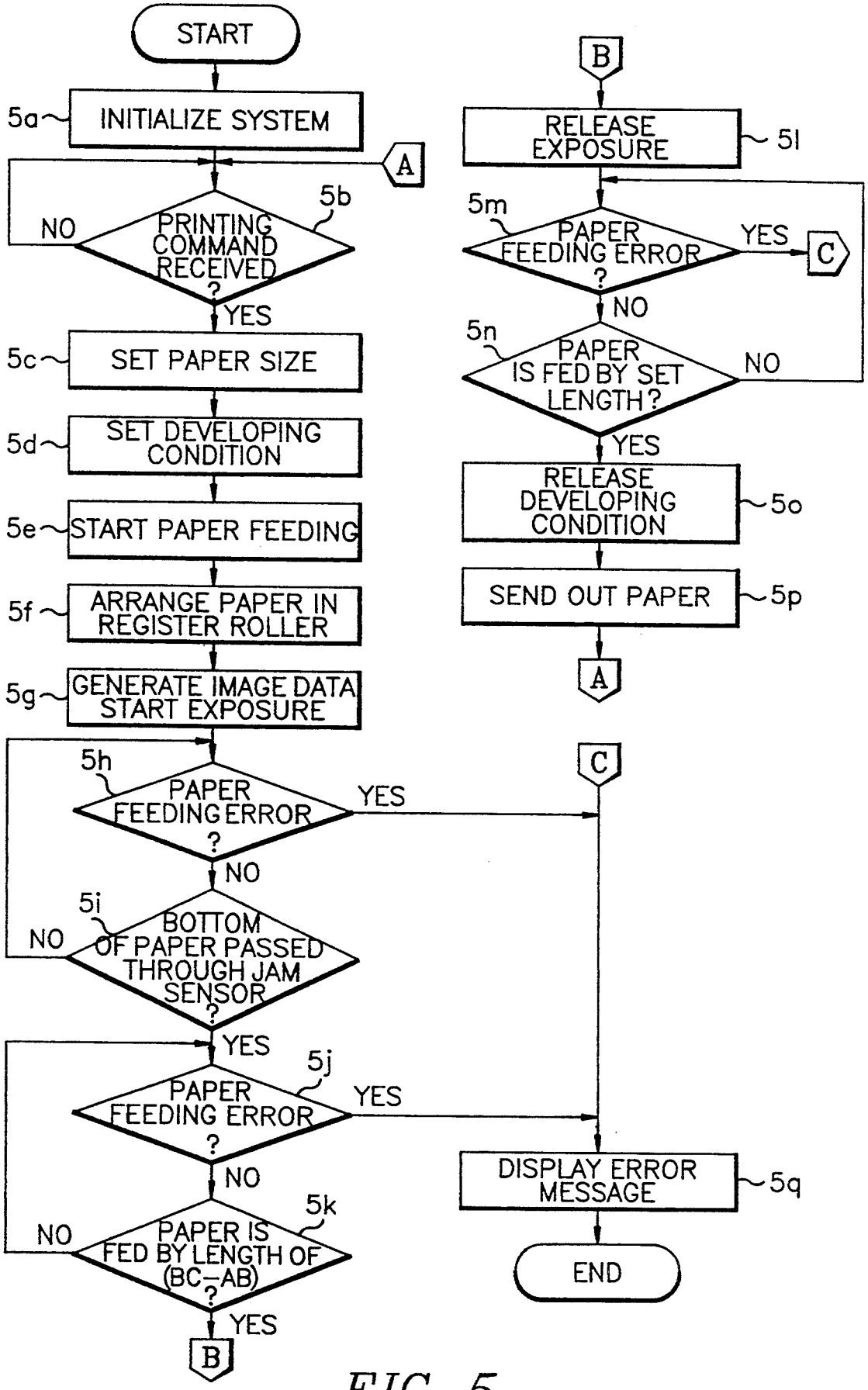
FIG. 5 is a flow chart of a preferred embodiment according to the present invention.

Referring to FIG. 5, the CPU and controlling circuit 404 initializes, at step 5*a*, the system. At step 5*b*, whether or not there is a printing command is checked. If there is the printing command, the paper size and a developing condition are set at steps 5*c* and 5*d*, and the paper feeding is started at step 5*e*. At step 5*f*, the paper is arranged in the register roller 109 by controlling the mechanical controlling circuit 401. At step 5*g*, image data is generated and an exposure is started by controlling the image data generating circuit 405 and the exposing data controlling circuit 406. At steps 5*h*, 5*i* and 5*j*, whether or not there are errors in the paper feeding and the bottom of the paper passes through the register sensor 111 (i.e., with sensor 111 serving as a location sensing sensor) are checked. If there are no errors in the paper feeding and the bottom of the paper passes through the register sensor 111, whether or not the paper is fed by the length of (BC-AB) is checked at step 5*k* in order to equalize the exposure image data and the bottom of the paper. If the paper is fed by the length of (BC-AB), the exposure is released at step 51. At step 5*m*, a check is made to see if there are errors in the paper feeding. If there are no errors in the paper feeding, whether or not the paper is fed as much as the set length is checked at step 5*n*. If the paper is fed as much as the set length, the developing condition is released in step 5*o* and the paper is sent out at step 5*p*.

Figure 6:
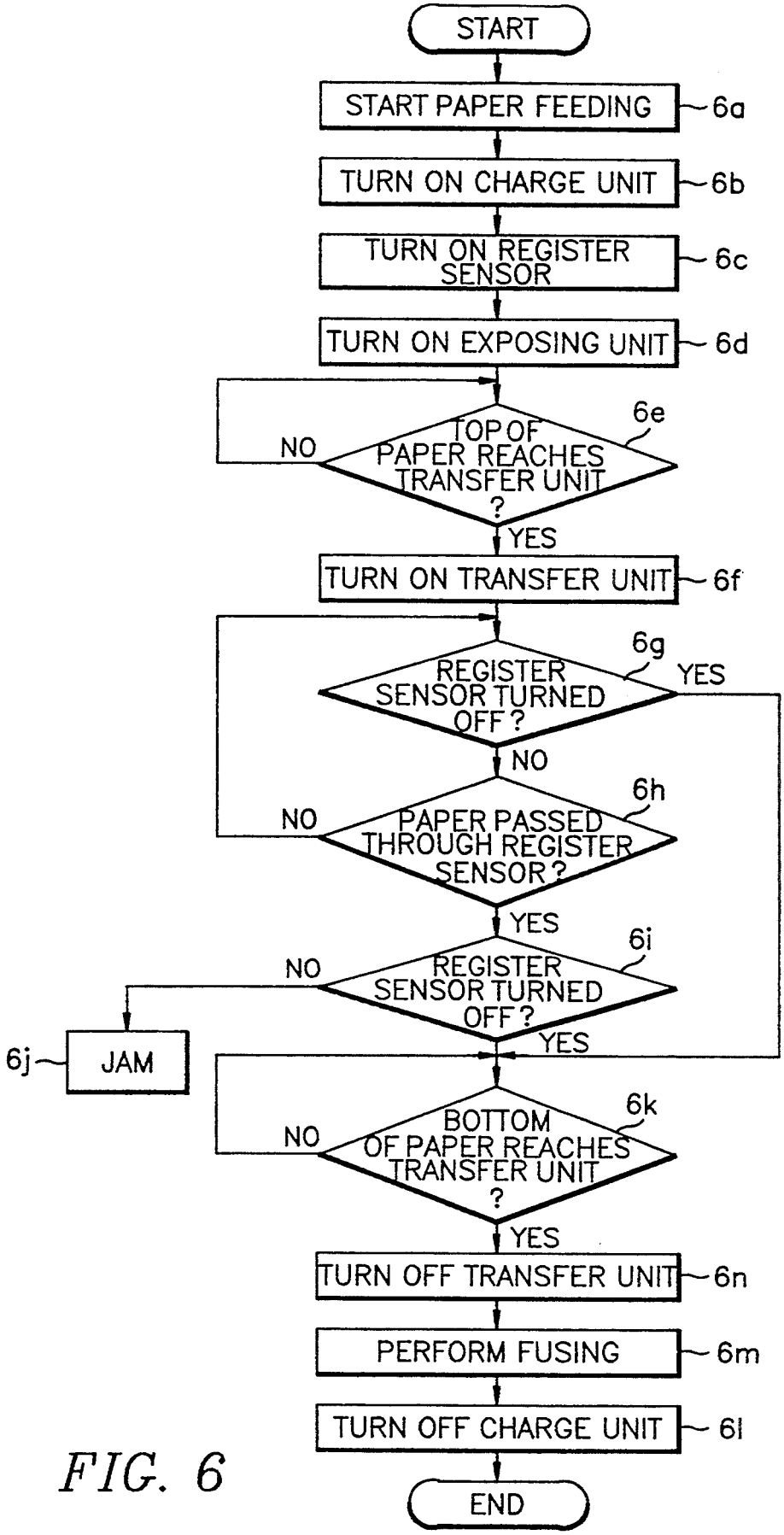
FIG. 6 is a flow chart of another preferred embodiment according to the present invention.

Referring to FIG. 6, a method for preventing reverse charge comprises the steps of: starting print paper feeding, turning on a charge unit, a register sensor and an exposing unit, and checking if the top of a paper reaches a transfer unit; if the top of the paper reaches the transfer unit, turning on the transfer unit; checking if the register sensor is turned off; if the register sensor is turned off, checking if it is time the bottom of the paper reaches the transfer unit; and if the time elapses, turning off the transfer unit, performing fusing, and turning off the charge unit.

In a series of the steps, if the printing paper passes through the register sensor 111, the register sensor 111 is turned on, and if the bottom of the paper completely passes through the register sensor 111 by the continuous paper feeding, the register sensor 111 is turned off. This operation is processed in the CPU and controlling circuit 404. The CPU and controlling circuit 404 counts a period of time and then turns off the transfer unit 106. Therefore, the unnecessary toner is not transferred to the transfer unit 106 and there is no a harmful effect on an image caused by the reverse charge of the photosensitive drum 107.

Referring again to FIG. 6, if a start driving signal is applied, the CPU and controlling circuit 404 controls the mechanical controlling circuit 401 by a checked result. At step 6*a*, the paper feeding is started. At step 6*b*, the charge unit 104 is turned on by controlling the developing processor controlling circuit 402, and step 6*c*, the register sensor 111 is turned on through the sensor input circuit 403. At step 6*d*, the exposing unit 105 is turned on through the image data generating circuit 405.

When the paper reaches the transfer unit 106 through the register sensor 111 and the register roller 109 by the control of the mechanical controlling circuit 401, the CPU and controlling circuit 404 checks, at step 6*e*, whether or not the top of the paper reaches the transfer unit 106 by counting a time point passing through the register sensor 111. At step 6*f*, the transfer unit 106 is turned on by controlling the developing processor controlling circuit 402. At step 6*g*, whether or not the register sensor 111 is turned off is checked. If the register sensor 111 is turned off, step 6*g* advances to step 6*k* to see if the bottom of the paper reaches the transfer unit 106. If the bottom of the paper reaches the transfer unit 106, the transfer unit 106 is turned off, at step 6*l*, by controlling the developing processor controlling circuit 402. At step 6*m*, fusing is performed in the fusing unit 103 by the operation of the mechanical controlling circuit 401, and at step 6*n*, the charge unit 104 is turned off by the control of the developing processor controlling circuit 402. At step 6*g*, if the register sensor 111 is not turned off, step 6*g* is followed by step 6*h* to check if it is time the paper passes through the register sensor 111. If the corresponding time elapses, whether or not the register sensor 111 is turned off is checked at step 6*i*.

As can be appreciated from the foregoing description, when creating a printed image with a shorter paper than a standard printing medium in the printers such as a laser beam printer and a light emitting display (LED) printer applying an electrophotographic processor, since both the exposure unit and the transfer unit are controlled by the actual paper size, any unnecessary consumption of the toner and undesirable contamination in the apparatus could be prevented, thereby obtaining clearer image.

While preferred embodiments of the present invention have been particularly shown and described, it will be understood by those skilled in the art that foregoing and other changes in form and details may be made without departing from the spirit and scope of the present invention.

What is claimed is:

1. A method for controlling exposure in an electrophotographic recording apparatus, comprising the steps of:

setting a size for a sheet of paper to be printed;

arranging the sheet of paper in a register roller, beginning formation of an electrostatic latent image on a photosensitive drum by starting exposure of said photosensitive drum with image data, and equalizing a top margin of the sheet of paper and said image data;

developing said electrostatic image on said photosensitive drum by applying developer to said photosensitive drum to form a developer image on said photosensitive drum;

transferring said developer forming said developer image on said photosensitive drum to the sheet of paper as the sheet of paper travels past said photosensitive drum;

checking whether a trailing edge of the sheet of paper reaches a desired position by using a location sensing sensor sensitive to presence of paper; and maintaining said exposure until the trailing edge of the sheet of paper passes through said location sensing sensor, and suppressing the exposure when the trailing edge of the sheet of paper reaches said desired position by transmitting said image data to an exposing unit of said recording apparatus with said image data representing a white image.

2. A method for controlling exposure in an electrophotographic recording apparatus, comprising the steps of:

setting a size of a printable medium and setting a developing condition for said printable medium in response to a printing command;

feeding the printable medium into said electrophotographic recording apparatus;

generating image data representative of data information to be printed onto the printable medium and starting exposure of a photosensitive drum with said image data;

checking whether the trailing edge of the printable medium has been fed by a set length toward said photosensitive drum before reaching said photosensitive drum;

terminating said exposure when the trailing edge of the printable medium has been fed by said set length;

releasing said developing condition; and discharging said printable medium from said electrophotographic recording apparatus.

3. An electrophotographic recording apparatus, comprising:

drum means for receiving an electrostatic latent image;

charging means for providing electrostatic charges to the drum means;

exposing means for generating an exposure forming the electrostatic latent image on the drum means in response to exposure data;

developing means for developing said electrostatic latent image on said drum means;

means for transferring said electrostatic latent image from the drum means to a printable medium;

means for fusing the developer onto the printable medium;

controller means for controlling the feeding of the printable medium and for controlling the charging device, the developing means and the transferring means;

location sensing means for indicating passage of a sheet of a printable medium in proximity to a junction between said transferring means and said drum means;

image data generator means for generating image data corresponding to information to be printed on the sheet of the printable medium;

exposure controlling means connected to said image data generator means, for providing said exposure data to the exposing means in response to reception of said image data; and processing means for suppressing formation of said electrostatic latent image in dependence upon passage of a trailing edge of the sheet of the printable medium through said location sensing means.

4. The apparatus of claim 3, comprising:

said image data generator means receiving said information to be recorded upon a first sheet of the printable medium designated as having a first length along a path of conveyance of the printable medium through the apparatus and accommodating a recording of said information distributed over said first length;

said exposure controlling means transmitting said exposure data corresponding to said image data; and said processing means suppressing said exposure by causing said exposure controlling means to transmit to said exposing unit exposure data enabling said exposure to form on said drum means a latent image representing a white image when said passage indicates a variance between said first length and an actual length of the printable medium along said path.

5. The apparatus of claim 4, comprising:

said drum means being positioned to engage the printable medium at a first location along said path of conveyance and said location sensing means being separated by a second length along said path from said first location to sense the printable medium;

said exposing means being separated from said first location by an arcuate length of a segment of said drum means defining a third length; and said processing means suppressing said exposure based upon a determination of whether said trailing edge of said printable medium has been advanced along said path by a distance substantially equal to a difference between said second length and said third length.

6. The apparatus of claim 3, comprising:

said image data generator means receiving said information to be recorded upon a first sheet of the printable medium exhibiting a first length along a path of conveyance of the printable medium through the apparatus and accommodating a recording of said information distributed over said first length;

said exposure controlling means transmitting said exposure data corresponding to said image data;

said drum means being positioned to engage the printable medium at a first location along said path of conveyance and said location sensing means being separated by a second length along said path from said first location to sense the printable medium before the printable medium reaches said first location;

said exposing means being separated from said first location by an arcuate length of a segment of said drum means defining a third length along said path; and said processing means suppressing said exposure based upon a determination of whether the printable medium has been advanced along said path by a distance substantially equal to a difference between said second length and said third length.

7. The apparatus of claim 6, comprising said second length being not less than said third length.

8. The apparatus of claim 3, comprised of:

said image data generator means receiving said information to be recorded upon an indicated size of the sheet of printable medium; and said processing means suppressing said exposure by causing said exposure controlling means to transmit to said exposing means exposure data causing said latent image to correspond to image data representing an absence of said information in dependance upon a variance between said passage and said size.

9. The electrophotographic recording apparatus of claim 3, comprising:

said location sensing means being positioned in proximity to said junction between said transferring means and said drum means, for providing indication of passage of the sheet of paper toward said junction.

10. The electrographic recording apparatus of claim 9, comprising:

a register roller spaced-apart from said drum means, and positioned to receive the sheet of the printable medium as the sheet of the printable medium is conveyed along a path through the electrophotographic recording apparatus; and said location sensing means being separated from said junction by said register roller.

11. An electrophotographic recording apparatus, comprising:

photosensitive drum means for receiving an electrostatic latent image;

feeding means for feeding a sheet of a printable medium along a path through said electrophotographic recording device and past said drum means;

charging means for providing an electrical charge to said drum means;

exposing means for generating an electrostatic latent image to said drum means;

developing means for developing said electrostatic latent image exposed on said drum means;

transferring means for transferring developer formed in said drum means to the printable medium having a leading edge and a trailing edge, as the printable medium is fed by said feeding means to pass between said drum means and said transferring means;

location sensing means for providing an indication of passage of the printable medium in proximity to a junction between said transferring means and said drum means;

means for fusing the developer onto the printable medium;

controller means for controlling the feeding of the printable medium and the charging device;

image data generator means for generating image data corresponding to data information to be printed on the printable medium and providing to said exposing means control signals to enable said exposing means to begin generating said electrostatic latent image upon said drum means when said feeding means begins feeding said printable medium through said recording apparatus and to cease generating said electrostatic latent image upon said drum means after said trailing edge of the printable medium reaches said location sensing means; and exposure controlling means for receiving said image data produced by said image data generator means to transmit exposure data corresponding to said electrostatic latent image to said exposing means to enable said exposing means to generate and convey said electrostatic latent image to said drum means.

12. The apparatus of claim 11, comprising:

said image data generator means receiving said information to be printed upon a first sheet of the printable medium having a nominal length along a path of conveyance of the printable medium through the apparatus and accommodating a recording of said information distributed over said first length;

said exposure controlling means transmitting said exposure data corresponding to said image data;

said drum means being positioned to engage the printable medium at a first location along said path of conveyance and said location sensing means being separated by a second length along said path from said first location to sense the printable medium;

said exposing means being separated from said first location by an arcuate length of a segment of said drum means defining a third length; and said processing means suppressing said exposure based upon a determination of whether said trailing edge of said printable medium has been advanced along said path by a distance substantially equal to a difference between said second length and said third length.

13. The apparatus of claim 12, comprising said second length being not less than said third length.

14. The electrophotographic recording apparatus of claim 11, comprising:

said location sensing means being located in proximity to said junction between said transferring means and said drum means, for providing indication of movement of the printable means toward said junction.

15. The electrophotographic recording apparatus of claim 14, comprising:

said location sensing means being separated from said junction by said feeding means.

16. A method for controlling exposure in an electrographic image forming apparatus, comprising:

setting a size of a sheet of paper to be printed and conditions of a developing processor according to a printing command;

arranging the sheet of paper in a register roller, starting an exposure by the apparatus when the paper is moved to a given position, and equalizing a top margin of the paper and image data;

checking whether the paper has reached a predetermined position within the apparatus by using a location sensor sensitive to presence of the paper; and maintaining said exposure until the trailing edge of the sheet of paper passes through said location sensor and suppressing said exposure in dependence upon passage of the trailing edge of the sheet of paper through said location sensor.

17. The method of claim 16, comprising:

receiving image data representing information to be recorded upon said size of the sheet of paper;

creating said exposure by transmitting said image data to an exposing unit forming a latent image upon a photosensitive drum with said latent image corresponding to said image data; and suppressing said exposure by transmitting to said exposing unit exposure data causing said latent image to correspond to image data representing an absence of said information.

18. The method of claim 16, comprising:

receiving image data representing information to be recorded upon a first sheet of paper exhibiting a first length along a path of conveyance of the printable medium through the apparatus and accommodating a reproduction of said information distributed over said first length;

creating said exposure by transmitting said image data to an exposing unit forming a latent image on a photosensitive drum with said latent image corresponding to said image data; and suppressing said exposure by transmitting to said exposing unit exposure data causing said latent image to correspond to image data representing a white image when said passage indicates a variance between said first length and an actual length of the printable medium along said path.

19. The method of claim 16, comprised of:

creating said exposure by transmitting said image data to an exposing unit forming a latent image upon a photosensitive dram with said latent image corresponding to said image data; and locating said predetermined position at a location spaced-apart from the drum.

20. A method for controlling exposure in an electrographic image forming apparatus, comprising:

setting a size of a sheet of paper to be printed and conditions of a developing processor according to a printing command;

arranging the sheet of paper in a register roller, starting an exposure by the apparatus when the paper is moved to a given position, and equalizing a top margin of the paper and image data;

checking whether the paper has reached a predetermined position within the apparatus by using a location sensor sensitive to presence of the paper;

maintaining said exposure until the trailing edge of the sheet of paper passes through said location sensor;

sensing passage of the trailing edge of the sheet of paper past said location sensor; and suppressing said exposure in dependence upon whether the sheet of paper has been fed past said location sensor by a predetermined distance.

21. The method of claim 20, comprising:

receiving image data representing information to be recorded upon said size of the sheet of paper;

creating said exposure by transmitting said image data to an exposing unit forming a latent image upon a photosensitive drum with said latent image corresponding to said image data; and suppressing said exposure by transmitting to said exposing unit exposure data causing said latent image to correspond to image data representing an absence of said information.

22. The method of claim 21, comprising:

positioning said photosensitive drum to engage the sheet of paper at a first location along a path of conveyance of the paper through said apparatus with said location sensor being positioned to sense the paper and being separated by a first length along said path from said first location;

separating said exposing unit from said first location by an arcuate length of a segment of said photosensitive drum defining a second length; and suppressing said exposure when said trailing edge of said sheet of paper has been advanced by said predetermined distance, said predetermined distance being substantially equal to a difference between said first length and said second length.

23. The method of claim 20, comprising:

receiving image data representing information to be recorded upon a first sheet of paper designated as having a first length along a path of conveyance of the printable medium through the apparatus and accommodating a reproduction of said information distributed over said first length;

creating said exposure by transmitting said image data to an exposing unit forming a latent image on a photosensitive drum with said latent image corresponding to said image data; and suppressing said exposure by transmitting to said exposing unit exposure data causing said latent image to correspond to image data representing a white image when said passage indicates a variance between said first length and an actuate length of the printable medium along said path.

24. The method of claim 23, comprising:

positioning said photosensitive drum to engage the sheet of paper at a first location along a path of conveyance of the paper through said apparatus with said location sensor being positioned to sense the paper and being separated by a first length along said path from said first location;

separating said exposing unit from said first location by an arcuate length of a segment of said photosensitive drum defining a second length; and suppressing said exposure when said trailing edge of said sheet of paper has been advanced by said predetermined distance, said predetermined distance being substantially equal to a difference between said first length and said second length.

25. The method of claim 20, comprising:

receiving image data representing information to be recorded upon said size of the sheet of paper;

creating said exposure by transmitting said image data to an exposing unit forming a latent image upon a photosensitive drum with said latent image corresponding to said image data;

positioning said photosensitive drum to engage the sheet of paper at a first location along a path of conveyance of the paper through said apparatus with said location sensor being positioned to sense the paper and being separated by a first length along said path from said first location;

separating said exposing unit from said first location by an arcuate length of a segment of said photosensitive drum defining a second length; and suppressing said exposure when said trailing edge of said sheet of paper has been advanced by said predetermined distance, said predetermined distance being substantially equal to a difference between said first length and said second length.

26. A method for controlling exposure in an electrophotographic recording apparatus, comprising the steps of:

setting a size for a sheet of paper to be printed and conditions of a recording processor controlling printing according to a printing command;

feeding the sheet of paper along a path of conveyance into the electrophotographic recording apparatus;

arranging the sheet of paper in a register roller, starting an exposing unit of said recording apparatus to provide exposure of a photosensitive drum with image data representative of information to be printed on the sheet of paper, and equalizing a top margin of the sheet of paper and said image data;

checking whether a trailing edge of the sheet of paper reaches a desired position by using a location sensing sensor;

transferring a visible image corresponding to said exposure, from said photosensitive drum and onto the sheet of paper white the sheet of paper traverses said path of conveyance; and maintaining said exposure unit the trailing edge of the sheet of paper passes through said location sensing sensor and suppressing the exposure after the trailing edge of the sheet of paper passes through said location sensing sensor, so that said image data transmitted to an exposing unit of said recording apparatus after the trailing edge of the sheet of paper passes through said location sensing sensor may represent a white image.

* * * * *

UNITED STATES PATENT AND TRADEMARK OFFICE

CERTIFICATE OF CORRECTION

PATENT NO. :5,444,830
DATED :22 August 1995
INVENTOR(S) :Soo–Hwan Oh, et al.

It is certified that error appears in the above-indentified patent and that said Letters Patent is hereby corrected as shown below:

| | | |
|---|---|---|
| Column 9, | Line50, | change "dram" to --drum--; |
| Column 12, | Line 14, | change "white" to --while--: |

Signed and Sealed this

Twenty-second Day of July, 1997

Bruce Lehman

*Attest:*

BRUCE LEHMAN

*Attesting Officer*

*Commissioner of Patents and Trademarks*